US010801496B2

(12) United States Patent
Obrist et al.

(10) Patent No.: US 10,801,496 B2
(45) Date of Patent: Oct. 13, 2020

(54) POSITIVE-DISPLACEMENT MACHINE ACCORDING TO THE SPIRAL PRINCIPLE, METHOD FOR OPERATING A POSITIVE-DISPLACEMENT MACHINE, POSITIVE-DISPLACEMENT SPIRAL, VEHICLE AIR-CONDITIONING SYSTEM AND VEHICLE

(71) Applicant: OET GmbH, Lustenau (AT)

(72) Inventors: Frank Obrist, Bregenz (AT); Christian Schmälzle, Lauterach (AT); Christian Busch, Feldkirch (AT)

(73) Assignee: OET GmbH, Lustenau (AT)

( * ) Notice: Subject to any disclaimer, the term of this patent is extended or adjusted under 35 U.S.C. 154(b) by 254 days.

(21) Appl. No.: 15/916,527

(22) Filed: Mar. 9, 2018

(65) Prior Publication Data

US 2018/0258933 A1 Sep. 13, 2018

(30) Foreign Application Priority Data

Mar. 10, 2017 (DE) ..... 10 2017 105 175

(51) Int. Cl.
*F04C 18/02* (2006.01)
*F04C 29/00* (2006.01)

(52) U.S. Cl.
CPC ..... *F04C 18/0253* (2013.01); *F04C 18/0215* (2013.01); *F04C 29/0021* (2013.01)

(58) Field of Classification Search
CPC ..... F04C 18/0253; F04C 18/0292; F04C 29/0021
See application file for complete search history.

(56) References Cited

U.S. PATENT DOCUMENTS 10,487,831 B2 11/2019 Ohta et al.
2010/0158710 A1* 6/2010 Umemura ..... F04C 18/0215 417/310

(Continued)

FOREIGN PATENT DOCUMENTS

AU 2009239310 10/2009
DE 102012104045 A1 11/2013

(Continued)

OTHER PUBLICATIONS

"Japanese Application No. 2018-029329, Notice of Reasons for Rejection dated Apr. 9, 2019", (Apr. 9, 2019), 8.

(Continued)

*Primary Examiner* — Mary Davis
(74) *Attorney, Agent, or Firm* — Schwegman Lundberg & Woessner, P.A.

(57) ABSTRACT

The invention relates to a positive-displacement machine according to the spiral principle, particularly a scroll compressor, having a high-pressure region, which comprises a high-pressure chamber, furthermore having a low-pressure chamber and an orbiting positive-displacement spiral, which engages into a counterpart spiral in such a manner that compression chambers are formed between the positive-displacement spiral and the counterpart spiral, in order to accommodate a working medium, wherein a counterpart-pressure chamber is constructed between the low-pressure chamber and the positive-displacement spiral. According to the invention, the positive-displacement spiral has at least two passages, which at least temporarily produce a fluid connection between the counterpart-pressure chamber and at least one of the compression chambers, wherein a first passage is essentially constructed in a central section of the positive-displacement spiral and at least one second passage (Continued)

is constructed in the initial region of the positive-displacement spiral.

11 Claims, 7 Drawing Sheets

(56) References Cited

U.S. PATENT DOCUMENTS

| | | | | |
|---|---|---|---|---|
| 2012/0230854 | A1 | 9/2012 | Chikano et al. | |
| 2013/0216416 | A1 | 8/2013 | Takeda et al. | |
| 2014/0119971 | A1 | 5/2014 | Shiibayashi et al. | |
| 2014/0348679 | A1 | 11/2014 | Ignatiev et al. | |
| 2014/0348681 | A1* | 11/2014 | Obrist ..... | F04C 18/0207 418/55.5 |
| 2015/0104342 | A1 | 4/2015 | Yamazaki et al. | |
| 2015/0260189 | A1 | 9/2015 | Kato | |

FOREIGN PATENT DOCUMENTS

| | | | |
|---|---|---|---|
| EP | 2474740 | A1 | 7/2012 |
| EP | 2806164 | | 11/2014 |
| JP | H0921389 | A | 1/1997 |
| JP | 2005180320 | A | 7/2005 |
| JP | 2013213480 | A | 10/2013 |
| JP | 2015075079 | A | 4/2015 |
| JP | 2016061208 | | 4/2016 |
| WO | WO-2009130878 | | 10/2009 |

OTHER PUBLICATIONS

"International Application Serial No. PCT/EP2018/055908, International Search Report and Written Opinion dated May 8, 2018", (w/ English Translation), 20 pgs.

"Korean Application Serial No. KR20180026722, Office Action dated May 11, 2020", (w English Translation), 10 pgs.

* cited by examiner

POSITIVE-DISPLACEMENT MACHINE ACCORDING TO THE SPIRAL PRINCIPLE, METHOD FOR OPERATING A POSITIVE-DISPLACEMENT MACHINE, POSITIVE-DISPLACEMENT SPIRAL, VEHICLE AIR-CONDITIONING SYSTEM AND VEHICLE

CLAIM OF PRIORITY

This application claims the benefit of priority of German Application Serial No. 10 2017 105 175.9, filed Mar. 10, 2017, entitled Verdrängermaschine nach dem Spiralprinzip, Verfahren zum Betreiben einer Verdrängermaschine, Verdrängerspirale, Fahrzeugklimaanlage and Fahrzeug" which is incorporated herein by reference in its entirety.

The invention relates to a positive-displacement machine according to the spiral principle, particularly a scroll compressor, having a high-pressure region, which comprises a high-pressure chamber, furthermore having a low-pressure chamber and an orbiting positive-displacement spiral, which engages into a counterpart spiral in such a manner that compression chambers are formed between the positive-displacement spiral and the counterpart spiral, in order to accommodate a working medium, wherein a counterpart-pressure chamber is constructed between the low-pressure chamber and the positive-displacement spiral. Furthermore, the invention relates to a positive-displacement spiral for a positive-displacement machine according to the spiral principle, particularly for a scroll compressor. Furthermore, the invention relates to a method for operating a positive-displacement machine. In addition, the invention relates to a vehicle air-conditioning system and a vehicle having a positive-displacement machine according to the invention.

BACKGROUND OF THE INVENTION

Scroll compressors and/or scroll expanders have been known for a long time from the prior art. These comprise a high-pressure chamber, a low-pressure chamber and an orbiting positive-displacement spiral. The orbiting positive-displacement spiral engages into a counterpart spiral, as is illustrated for example in EP 2 806 164 A1, in such a manner that compression chambers are formed between the positive-displacement spiral and the counterpart spiral, in order to accommodate a working medium. An accommodating space is constructed between the low-pressure chamber and the positive-displacement spiral, namely a counterpart-pressure chamber. A counterpart-pressure chamber of this type is also known under the term back-pressure space. With the aid of the counterpart-pressure chamber or with the aid of the back-pressure space, it is possible to build a pressure, which acts on the orbiting positive-displacement spiral. A resultant force is created in the axial direction, as a result of which the positive-displacement spiral is pressed against the counterpart spiral and thus the spirals are sealed with respect to one another.

SUMMARY OF THE INVENTION

The invention is based on the object of developing a positive-displacement machine according to the spiral principle in such a manner that the pressure in the counterpart-pressure chamber itself can be set in an advantageous manner. A variable back-pressure system or a variable counterpart-pressure system should be provided, wherein the pressure in the counterpart-pressure chamber can be set on the basis of different operating pressures. The invention is further based on the object of specifying a developed positive-displacement spiral. Furthermore, the object consists in specifying a developed method for operating a positive-displacement machine. In addition, the object consists in specifying a vehicle air-conditioning system and/or a vehicle with a developed positive-displacement machine according to the spiral principle.

According to the invention, this object is achieved with regards to the positive-displacement machine according to the spiral principle, with regards to the positive-displacement spiral, with regards to the method for operating a positive-displacement machine, with regards to the vehicle air-conditioning system, and with regards to the vehicle by means of the subject matter of the claims.

Advantageous and expedient configurations of the positive-displacement machine according to the spiral principle according to the invention and/or of the method according to the invention for operating a positive-displacement machine are specified in the dependent claims.

The invention is based on the idea of specifying a positive-displacement machine according to the spiral principle, particularly a scroll compressor, having a high-pressure chamber, a low-pressure chamber and an orbiting positive-displacement spiral, which engages into a counterpart spiral in such a manner that compression chambers are formed between the positive-displacement spiral and the counterpart spiral, in order to accommodate a working medium. A counterpart-pressure chamber or what is known as a back-pressure space is constructed between the low-pressure chamber and the positive-displacement spiral.

According to the invention, the positive-displacement spiral has at least two passages, which at least temporarily produce a fluid connection between the counterpart-pressure chamber and at least one of the compression chambers, wherein a first passage is essentially constructed in a central section of the positive-displacement spiral and at least one second passage is constructed in the initial region of the positive-displacement spiral.

The construction of the at least two passages effects a fluid connection or gas connection between at least one of the compression chambers and the counterpart-pressure chamber. A back-pressure system or a counterpart-pressure system can be provided as a result, wherein the pressure in the counterpart-pressure chamber can be set by means of a balance between the high pressure and the suction pressure or low-pressure of the positive-displacement machine.

The counterpart spiral is preferably installed into the positive-displacement machine in a completely fixed manner. In other words, the counterpart spiral is neither movable in the axial direction, nor movable in a rotatable manner. The positive-displacement spiral is movable in the axial direction relatively to the counterpart spiral. Thus, the orbiting, that is to say the rotatably movable positive-displacement spiral can additionally be movable in the axial direction. Here, the positive-displacement spiral can be moved in the direction of the counterpart spiral and away from the counterpart spiral.

A contact pressure acting in the axial direction from the positive-displacement spiral onto the counterpart spiral can be set by means of the described pressure prevailing in the counterpart-pressure chamber. In other words, the force acting in the axial direction from the positive-displacement spiral onto the counterpart spiral is preferably effected by means of the pressure prevailing in the counterpart-pressure chamber. A contact pressure acting in the axial direction form the positive-displacement spiral onto the counterpart spiral can be set as a function of the pressure prevailing in the counterpart-pressure chamber.

Preferably, the positive-displacement spiral always acts with a certain contact pressure on the counterpart spiral, so that the tightness of the arrangement of the two spirals is ensured. The contact pressure onto the counterpart spiral is preferably set in such a manner that no higher contact pressure acts on the counterpart spiral than is necessary for the tightness at the current operating point (operating pressures/rotational speed) of the compressor. An increased contact pressure in this regard would lead to performance losses of the positive-displacement machine.

Radially inwardly migrating compression chambers are formed between the positive-displacement spiral and the counterpart spiral, in order to accommodate, particularly suck in, a working medium, particularly a coolant, from the low-pressure chamber, to compress the same and to expel the same into the high-pressure chamber. According to this embodiment of the invention, the positive-displacement machine operates as a scroll compressor in particular. In other words, this positive-displacement machine is a scroll compressor.

The first passage and/or the at least second passage is/are preferably constructed in a section of the base of the positive-displacement spiral. This means that the first passage and/or the second passage in particular are not constructed in the spiral flank sections of the positive-displacement spiral.

The first passage and/or the at least second passage is/are preferably constructed as (a) passage(s) constructed essentially perpendicularly with respect to the base of the positive-displacement spiral. Preferably, the first passage and/or the at least second passage is/are (a) hole(s). The first passage in this case preferably has a diameter of 0.1 mm-1.0 mm. The at least second passage preferably has a diameter of 0.1 mm-1.0 mm.

A central section of the positive-displacement spiral is in particular understood to mean a section of the positive-displacement spiral, which, although it does not form the centre point of the positive-displacement spiral, is constructed in the vicinity of the centre point of the positive-displacement spiral. The central section is in this case formed between two flanks of the positive-displacement spiral. For example, the first passage is constructed centrally between two flank sections. Furthermore, it is possible that the first passage is arranged eccentrically in relation to two flank sections.

The first passage is preferably constructed in a first spiral winding in relation to the centre point of the positive-displacement spiral.

The second passage of the positive-displacement spiral is preferably constructed in a second and/or an outermost spiral winding of the positive-displacement spiral in relation to the centre point of the positive-displacement spiral. The initial region of the positive-displacement spiral in particular describes the region of the positive-displacement spiral in which the coolant is received, particularly sucked, from the low-pressure chamber. The initial region can also be termed the intake region.

The initial region of the positive-displacement spiral is the first flow section of the intake coolant, which is constructed between two flanks of the positive-displacement spiral.

Preferably, the first passage and the second passage do not lie in a straight line in relation to the centre point of the positive-displacement spiral, but rather are arranged offset with respect to the centre point.

Preferably, the first passage is constructed in a section of the positive-displacement spiral of this type, in which the first passage in the activated state of the positive-displacement machine is open when 95%-85%, particularly when 92%-88%, particularly when 90%, of the relative compression chamber volume is reached, and remains open during a rotation of the positive-displacement spiral, subsequent to the opening, by an angle of rotation of 180°-360°, particularly of 255°-315°, particularly of 270°. This described section, in which the first passage is located, is preferably the described central section of the positive-displacement spiral. In other words, after the opening of the first passage, the positive-displacement spiral can be rotated by a further 180°-360°, particularly a further 255°-315°, particularly by a further 270°, whilst the first passage remains open. An opening state of the first passage describes that the first passage is not covered by the counterpart spiral, in particular not by the spiral element or by a spiral flank section.

The second passage is preferably constructed in a section of the positive-displacement spiral of this type, in which the second passage is closed when the maximum relative compression chamber volume is reached, and is open during a rotation, prior to the closure, of the positive-displacement spiral by an angle of rotation of 180°-360°, particularly of 255°-315°, particularly of 270°. The maximum compression chamber volume corresponds to an assigned angle of rotation ($\alpha$Vmax) of the positive-displacement spiral. With reference to the assigned angle of rotation, a tolerance range of +/−30° is possible. In other words, the second passage is closed when the angle of rotation $\alpha$Vmax+/−30° is reached.

In other words, the second passage 61 of the positive-displacement spiral is closed prior to the start of the compression process. Accordingly, the second passage is closed at least at the 0° angle of the positive-displacement machine. Preferably, the closure of the second passage 61 takes place already prior to the 0° angle of the positive-displacement machine being reached.

In particular, the second passage is closed when the maximum relative compression chamber volume is reached. Prior to that, i.e. before the value is reached, the second passage is open. Before the second passage is closed, the second passage may be open whilst a rotation of the positive-displacement spiral by an angle of rotation of 180°-360°, particularly of 255°-315°, particularly of 270°, is carried out. It is also true in this context that the opening of the second passage describes a state in which the second passage is not covered or closed by means of the counterpart spiral, particularly not by a flank section of the counterpart spiral.

Furthermore, it is possible that the first passage is open at an angle of rotation of the positive-displacement machine of 70°-360°, particularly of 75°-355°, particularly of 80°-350°. The first degree values of the specified ranges always relate to the angle of the positive-displacement machine, which is present during the opening process of the first passage.

As presented previously, the 0° angle of the positive-displacement machine describes the start of the compression between the positive-displacement spiral and the counterpart spiral. The 0° angle of the positive-displacement machine describes the state in which one of the at least two compression chambers is closed.

The second passage is preferably open at an angle of rotation of the positive-displacement machine of −410° to 40°, particularly of −365° to −5°, particularly of −320° to −50°. The negative values of the angle of rotation of the positive-displacement machine are to be interpreted in relation to the 0° angle of the positive-displacement machine. In other words, the negative angles relate to processes or rotational movements prior to the start of the compression.

In other words, the at least two passages, i.e. the first passage and the at least second passage are constructed in such sections of the positive-displacement spiral, that the above-mentioned conditions with regards to the opening or the opening time and the closing or the closing time can be achieved. Therefore different geometric designs with regards to the arrangement of the passages can be constructed as a function of the size of the positive-displacement machine. However, the above applies for all of the positive-displacement machines to be constructed, for the conditions mentioned with regards to the opening and closing of the passages.

Preferably, the first passage is closed at least at an angle of rotation of 10°, particularly of at least 20°, particularly of at least 30°, before reaching the discharge angle. The discharge angle describes the angle of rotation, at which the gas compressed in the compression chambers was discharged sufficiently into the high-pressure chamber and the pressure in the compression chamber decreases in a correspondingly sudden manner. In other words, the first passage is closed before the discharge angle is reached, particularly at least 10° before the discharge angle is reached, particularly at least 20° before the discharge angle is reached, particularly at least 30° before the discharge angle is reached. This means that compressed gas, which is present in the compression chambers, but was not discharged into the high-pressure chamber, remains in the compression chamber. This residual compressed gas, which was not discharged or expelled, must not reach the counterpart-pressure chamber or the back-pressure space. Therefore, the first passage is to be closed in good time before the discharge angle is reached.

Owing to the described openings or opening times of the first passage and the second passage, a variable back-pressure system or a variable counter-pressure system can be provided, wherein the pressure in the counterpart-pressure chamber can be set in an exceptionally advantageous manner on the basis of the balance between the high-pressure to be achieved and the low pressure or suction pressure prevailing in the low-pressure chamber.

In this context, the design of the second passage, which is constructed in the initial region of the positive-displacement spiral, is particularly advantageous. Consequently, both information about the pressure in the inner compression chambers and about the pressure in the initial region of the positive-displacement spiral can be tapped with the aid of the positive-displacement machine according to the invention.

Although the back pressure or counterpart pressure is always higher than the counteracting axial force owing to the compressed high pressures prevailing in the compression chambers, the back pressure in the different operating phases can be set to be lower than is the case with conventional positive-displacement machines, so that a more effective compression process can be realized with the aid of the positive-displacement machine according to the invention.

Gas-dynamic effects occur in the intake phase of the compression process in particular. An underpressure can for example occur in the intake region. An underpressure of this type automatically leads to the positive-displacement spiral being pressed onto the counterpart spiral, so that at this time in the compression process, a lower counterpart pressure can be set in the counterpart-pressure chamber. As a whole, the advantage that the actual pressures in the respective sections of the positive-displacement machine can be obtained due to the tapping of as much as information as possible from the compression chambers, which are located further in, and from the initial region or the intake region of the positive-displacement spiral, and can flow into generating the back pressure or counterpart pressure.

In the activated state of the positive-displacement machine, i.e. in the case of an orbiting movement of the positive-displacement spiral in the counterpart spiral, a plurality of compression chambers are formed, the space of which gets smaller from the outer radial circumference of the positive-displacement spiral towards the centre, so that the coolant gas accommodated at the circumference is compressed. The final compression pressure is reached in an axial region of the positive-displacement spiral, particularly in the central section of the positive-displacement spiral, and the coolant gas is discharged axially at the high pressure achieved. To this end, the counterpart spiral has an opening, so that a fluid connection to the high-pressure region, particularly to the high-pressure chamber is formed.

The temporary fluid connection between the counterpart-pressure chamber and at least one of the compression chambers is enabled by means of the arrangement of the passages and the orbiting movement of the positive-displacement spiral.

Furthermore, it is possible that in certain temporal sections of the compression process, both passages of the positive-displacement spiral are clear and thus fluid connections between the counterpart-pressure chamber and at least two compression chambers can be produced. Preferably, the passages are arranged in such a manner in the positive-displacement spiral, that both passages are closed at the start of the compression process, i.e. both passages are covered by spiral flank sections of the counterpart spiral.

Furthermore, it is possible that the positive-displacement machine is constructed in such a manner that a gas-connection line is constructed from the high-pressure region of the positive-displacement machine to the counterpart-pressure chamber. For example, the gas-connection line is constructed from the high-pressure chamber to the counterpart-pressure chamber. The gas-connection line can be constructed in the counterpart spiral and connect the high-pressure chamber to the counterpart-pressure chamber. In a further embodiment of the invention, the gas-connection line can be constructed in the housing of the positive-displacement machine.

Furthermore, an oil-return channel can be constructed starting from the high-pressure region of the positive-displacement machine to the low-pressure chamber. Thus, a separation of the oil flow from the coolant-gas flow can be realized within the compression process. In other words, the oil-return channel is preferably separated from the gas-connection line.

The second passage of the positive-displacement spiral, which produces a temporary fluid connection from the initial region of the positive-displacement spiral to the counterpart-pressure chamber, does not however produce a connection to the suction region or low-pressure region, particularly to the low-pressure chamber, of the positive-displacement machine. The mass flow of the coolant is sucked up in the region of the second passage, i.e. in the initial region of the spiral, and only conveyed or transported in the direction of the compression process between the two spirals, i.e. between the positive-displacement spiral and the counterpart spiral. The mass flow cannot pass from the counterpart-pressure chamber into the low-pressure region, particularly into the low-pressure chamber. As a result, a variable back-pressure system or a variable counterpart-pressure system may be provided, wherein the pressure of the counterpart-pressure chamber is set by means of a balance between the high pressure and the low pressure or suction pressure.

In a further embodiment of the invention, a nozzle may be constructed in the at least second passage.

The positive-displacement machine according to the invention can be constructed as an electrically and/or electromotively driven positive-displacement machine, or as a positive-displacement machine with a mechanical drive.

A coordinate aspect of the invention relates to a positive-displacement spiral for a positive-displacement machine according to the spiral principle, particularly a positive-displacement spiral for a positive-displacement machine according to the invention.

According to the invention, the positive-displacement spiral has at least two passages, wherein a first passage is essentially constructed in a central section of the positive-displacement spiral and at least one second passage is constructed in the initial region of the positive-displacement spiral.

With regards to the construction of the positive-displacement spiral according to the invention, reference is made to previous statements, particularly to the statements in connection with the first passage and/or the at least second passage and the relative arrangement of the passages with respect to one another or in relation to prevailing volumes in at least one of the compression chambers or in various compression chambers. Similar advantages result, as are already specified in connection with the positive-displacement machine according to the invention.

A further aspect of the invention relates to a method for operating a positive-displacement machine according to the invention. The method is based on the fact that the first passage is opened when 95%-85%, particularly when 92%-88%, particularly when 90%, of the relative compression chamber volume is reached, and remains open during a rotation of the positive-displacement spiral, subsequent to the opening, by an angle of rotation of 180°-360°, particularly of 255°-315°, particularly of 270°.

Furthermore, it is possible that the second passage is closed when 1.02-times to 1.03-times the relative compression chamber volume, particularly when the maximum relative compression chamber volume is reached, and is open during a rotation, prior to the closure, of the positive-displacement spiral by an angle of rotation of 180°-360°, particularly of 255°-315°, particularly of 270°.

With regards to further designs of the method according to the invention, reference is made to previous statements, particularly to the statements in connection with the opening and/or closing times or the opening durations of the passages. Similar advantages result, as are already specified in connection with the positive-displacement machine according to the invention.

A further coordinate aspect of the invention relates to a vehicle air-conditioning system having a positive-displacement machine according to the invention, particularly having a scroll compressor according to the invention. Similar advantages result, as are already specified in connection with the positive-displacement machine according to the invention and/or the positive-displacement spiral according to the invention for a positive-displacement machine.

A further coordinate aspect of the invention relates to a vehicle, particularly a hybrid vehicle, having a positive-displacement machine according to the invention and/or having a vehicle air-conditioning system according to the invention. Similar advantages result, as are already specified in connection with the positive-displacement machine according to the invention and/or with the positive-displacement spiral according to the invention for a positive-displacement machine. In particular, the vehicle according to the invention is an electric hybrid vehicle.

BRIEF DESCRIPTION OF THE DRAWINGS

In the following, the invention is explained in more detail on the basis of exemplary embodiments with reference to the accompanying, schematic drawings.

In the figures

FIG. 7 shows an illustration of expulsion cycles from the compression chamber into the high-pressure chamber and an illustration of the opening phases of the first passage in connection with the coolant R134a;

FIG. 10 shows the back-pressure curve whilst additionally displaying the compression pressure for the coolant R134a.

DETAILED DESCRIPTION

In the following, the same reference numbers are used for the same parts and parts with the same effect.

Figure 1:
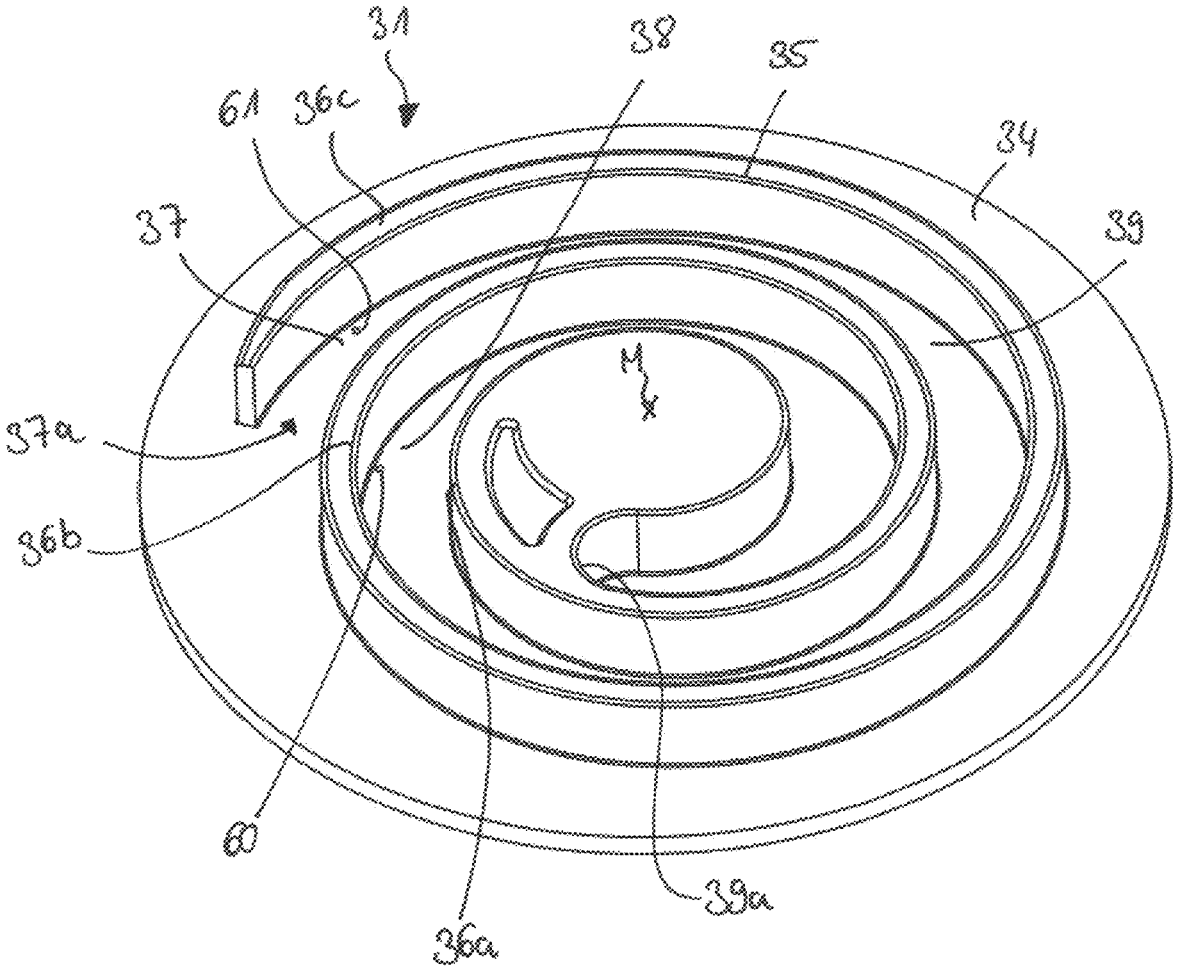
FIG. 1 shows a positive-displacement spiral according to the invention in a perspective plan view.

A positive-displacement spiral 31 according to the invention is illustrated in FIG. 1. This is used in particular for installation into a positive-displacement machine, particularly into a scroll compressor 10, according to the exemplary embodiment of FIG. 2.

As illustrated in FIG. 1, the positive-displacement spiral 31 comprises a base 34. The base 34 can also be termed the rear wall of the positive-displacement spiral 31. The base 34 is constructed in a circular manner and has the shape of a round plate. A spiral 35 with spiral flank sections 36*a*, 36*b* and 36*c* are constructed on the base 34.

The spiral element 35 extends starting from the centre point M up to an initial region 37.

Two passages, namely a first passage 60 and a second passage 61, are constructed in the base 34. The passages 60 and 61 are through holes, which essentially run perpendicularly to the surface of the base 34. The first passage 60 in this case is constructed in a central section 38 of the positive-displacement spiral 31. By contrast, the second passage 61 is constructed in the initial region 37 of the positive-displacement spiral 31.

The first passage 60 is constructed in a section of the base 34, wherein the first passage 60 is constructed eccentrically between the spiral flank sections 36*a* and 36*b*. By contrast, the second passage 61 is constructed eccentrically between the spiral flank sections 36*b* and 36*c*. The section of the duct 39 constructed between the spiral flank sections 36*c* and 36*b* are to be understood as the initial region 37, which section, starting from the opening 37*a*, corresponds approximately to a region of at most 10% of the total length of the spiral duct 39. The total length of the spiral duct 39 is defined starting from the opening 37*a* up to the end section 39*a* of the spiral duct 39. The end section 39*a* is the last section of the spiral duct 39 in the flow direction of the coolant. In the illustrated example, the end section 39*a* is constructed in a curved manner.

Figure 2:
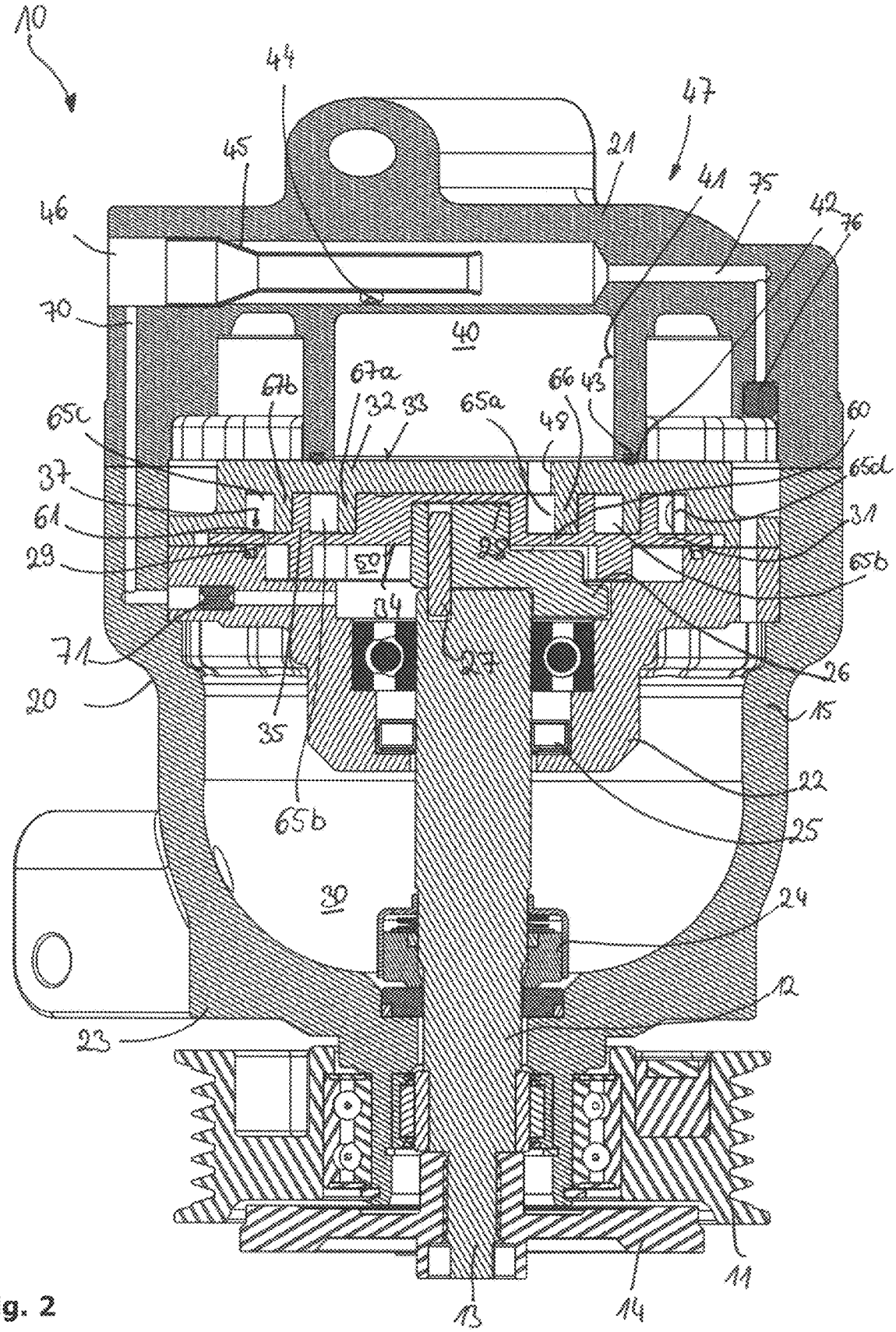
FIG. 2 shows a longitudinal section of a positive-displacement machine according to the invention, particularly of a scroll compressor.

The positive-displacement spiral 31 illustrated in FIG. 1 is installed in a scroll compressor 10 according to the exemplary embodiment of FIG. 2. This scroll compressor 10 can for example act as a compressor of a vehicle air-conditioning system. A vehicle air-conditioning system, such as e.g. a $CO_2$ vehicle air-conditioning system, typically has a gas cooler, an inner heat exchanger, a throttle, an evaporator and a compressor. The compressor can consequently be the depicted scroll compressor 10. The scroll compressor 10 in other words is a positive-displacement machine according to the spiral principle.

The illustrated scroll compressor 10 has a mechanical drive 11 in the form of a belt pulley. During use, the belt pulley 11 is connected to an electric motor or an internal combustion engine. Alternatively, it is possible that the scroll compressor is driven electrically or electromotively.

The scroll compressor 10 additionally comprises a housing 20 with an upper housing part 21, which closes the high-pressure region 47 of the scroll compressor 10. A housing partition wall 22 is constructed in the housing 20, which delimits a low-pressure chamber 30. The low-pressure chamber 30 can also be termed a suction space. A through opening is constructed in the housing base 23, through which a drive shaft 12 extends. The shaft end 13 arranged outside the housing 20 is connected in a rotationally fixed manner to the driver 14, which engages into the belt pulley mounted on the housing 20 in a rotatable manner, i.e. into the mechanical drive 11, so that a torque can be transmitted from the belt pulley to the drive shaft 12.

The drive shaft 12 is mounted in a rotatable manner in the housing base 23 on the one hand and in the housing partition wall 22 on the other hand. The sealing of the drive shaft 12 against the housing base 23 takes place by means of a first shaft seal 24 and against the housing partition wall 22 by means of a second shaft seal 25.

The scroll compressor 10 furthermore comprises the positive-displacement spiral 31 and a counterpart spiral 32. The positive-displacement spiral 31 and the counterpart spiral 32 engage into one another. The counterpart spiral 32 is preferably fixed both in the circumferential direction and in the radial direction. The movable positive-displacement spiral 31 coupled to the drive shaft 12 describes a circular path, so that a plurality of gas pockets or sealing chambers 65*a*, 65*b*, 65*c* and 65*d* are generated in a manner known per se by means of this movement, which migrate radially inwards between the positive-displacement spiral 31 and the counterpart spiral 32.

By means of this orbiting movement, working medium, particularly a coolant, is sucked in and, with the further spiral movement and the associated reduction in size of the sealing chamber 65*a*, 65*b*, 65*c* and 65*d*, sealed. The working medium, particularly the coolant, is compressed increasingly from radially outside to radially inside, for example linearly, and expelled in the centre of the counterpart spiral 32 into the high-pressure chamber 40.

In order to create an orbiting movement of the positive-displacement spiral 31, an eccentric bearing 26 is constructed, which is connected to the drive shaft 12 by means of an eccentric pin 27. The eccentric bearing 26 and the positive-displacement spiral 31 are arranged eccentrically with respect to the counterpart spiral 32. The compression chambers 65*a*, 65*b* and 65*c* are separated from one another in a pressure-tight manner by means of the bearing of the positive-displacement spiral 31 against the counterpart spiral 32.

The high-pressure chamber 40 is arranged downstream of the counterpart spiral 32 in the flow direction and is in fluid connection with the counterpart spiral 32 by means of an outlet 48. The outlet 48 is preferably not arranged exactly in the centre point of the counterpart spiral 32, but rather is located eccentrically in the region of an innermost compression chamber 65*a*, which is formed between the positive-displacement spiral 31 and the counterpart spiral 32. This means that the outlet 48 is not covered by the bearing bushing 28 of the eccentric bearing 26 and the fully compressed working medium can be expelled into the high-pressure chamber 40.

The base 33 of the counterpart spiral 32 forms the base of the high-pressure chamber 40 in certain sections. The base 33 is wider than the high-pressure chamber 40. The high-pressure chamber 40 is delimited at the side by the side wall 41. A recess 42 is formed in an end of the side wall 41 facing the base 33 of the counterpart spiral 32, in which recess a sealing ring 43 is arranged. The side wall 41 is a circumferential wall, which forms a stop of the counterpart spiral 32. The high-pressure chamber 40 is constructed in the upper housing part 21. This has a rotationally symmetrical cross section.

The compressed working medium collected in the high-pressure chamber 40, namely the cooling gas, flows through an outlet 44 out of the high-pressure chamber 40 into an oil separator 45, which in the present case is constructed as a cyclone separator. The compressed working medium, namely the compressed cooling gas, flows through the oil separator 45 and the opening 46 into the circuit of the exemplary air-conditioning system.

The control of the contact pressure of the positive-displacement spiral 31 against the counterpart spiral 32 is effected in that a base 34 of the positive-displacement spiral 31 is loaded with a corresponding pressure. A counterpart-pressure chamber 50, which can also be termed the back-pressure space, is also constructed. The eccentric bearing 26 is located in the counterpart-pressure chamber 50. The counterpart-pressure chamber 50 is delimited by the base 34 of the positive-displacement spiral 31 and by means of the housing partition wall 22.

The counterpart-pressure chamber 50 is separated from the low-pressure chamber 30 in a fluid-tight manner by means of the previously described second shaft seal 25. A sealing and sliding ring 29 sits in an annular groove in the housing partition wall 22. The positive-displacement spiral 31 is therefore supported in the axial direction on the sealing and sliding ring 29 and slides on the same.

As can likewise be seen in FIG. 2, the passages 60 and 61 of the positive-displacement spiral 31 can at least temporarily produce a fluid connection between the counterpart-pressure chamber 50 and the illustrated compression chambers 65*a* and 65*c*. In the cross section, it can clearly be seen that the first passage 60 is essentially constructed in a central section 38, and the second passage is constructed in the initial region 37 of the positive-displacement spiral 31.

The spiral element 66 of the counterpart spiral 32, particularly the spiral flank sections 67*a* and 67*b* can temporarily close the passages 60 and 61. In other words, the passages 60 and 61 are for example cleared in a simultaneous and/or temporally offset manner by means of corresponding displacement in relation to the spiral flank sections 67*a* and 67*b*, so that a working medium can flow from the compression chambers 65*a* and/or 65*b* and/or 65*c* and/or 65*d* in the direction of the counterpart-pressure chamber 50.

As is furthermore illustrated in FIG. 2, a gas-connection line 70 is constructed from the high-pressure region 47 of the positive-displacement machine or the scroll compressor 10 to the counterpart-pressure chamber 50. The gas-connection line 70 is constructed downstream of the oil separator 45, so that actually only gas and no oil is transported through the gas-connection line 70. A throttle 71 is constructed in the gas-connection line 70.

In an alternative design of the invention (not illustrated), a gas-connection line can be constructed in the counterpart spiral 32. A gas-connection line of this type can produce a connection from the high-pressure chamber 40 to the counterpart-pressure chamber 50.

It is to be mentioned that the second passage 61 does not produce a connection into the low-pressure chamber 30, as the mass flow of a coolant is sucked up in this region and is only transported in the direction of the compression process, i.e. in the direction of the compression chambers 65*a*, 65*b*, 65*c* and 65*d* between the two spirals 31 and 32. The mass flow cannot pass from the counterpart-pressure chamber 50 into the low-pressure chamber 30.

As is furthermore indicated in FIG. 2, an oil return channel 75 with a throttle 76 is constructed starting from the high-pressure region 47. An oil return channel 75 of this type produces a connection from the high-pressure region 47 to the low-pressure region 30, in order to ensure oil return. Thus, a separate oil return and a separate gas return can be realized.

With the aid of the scroll compressor according to the invention or with the aid of the use of a positive-displacement spiral 31 according to the invention, a variable back-pressure system, i.e. a variable counterpart-pressure system can be constructed, wherein the pressure in the counterpart-pressure chamber 50 is set by means of a balance between the high pressure prevailing in the high-pressure region 47 and the suction pressure or low pressure prevailing in the low-pressure chamber 30.

This is based inter alia on the arrangement of the passages 60 and 61.

Figure 3A:
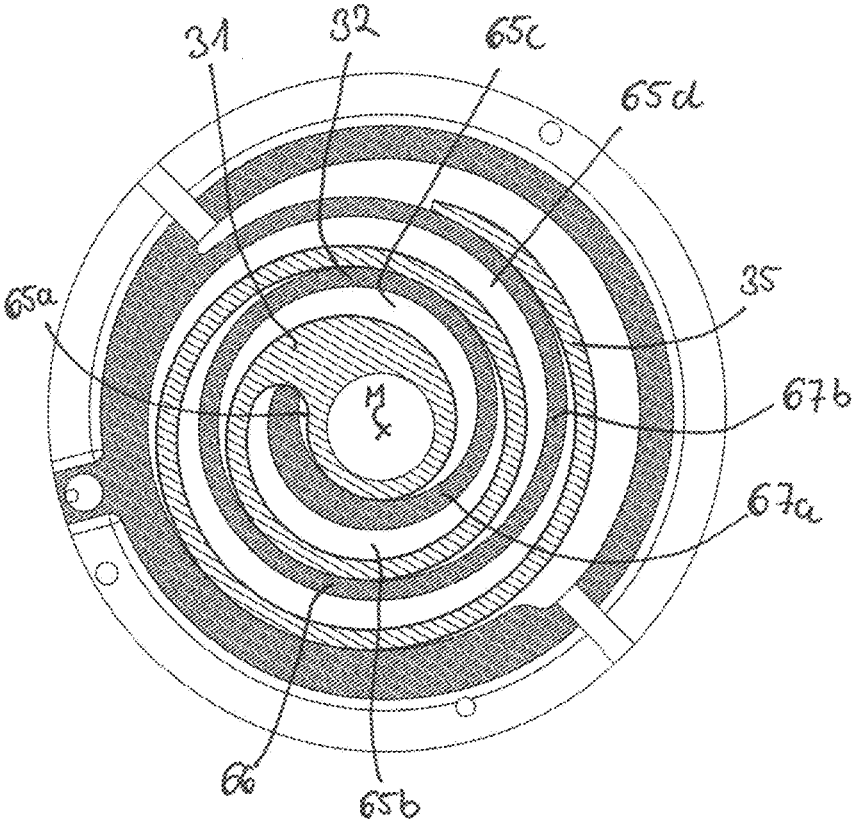
FIGS. 3*a*+3*b* show various positionings and method states of a positive-displacement machine according to the invention, with a plan view onto the positive-displacement spiral, which carries out orbiting movements in the counterpart spiral, wherein the base of the counterpart spiral is not illustrated.
Figure 3B:
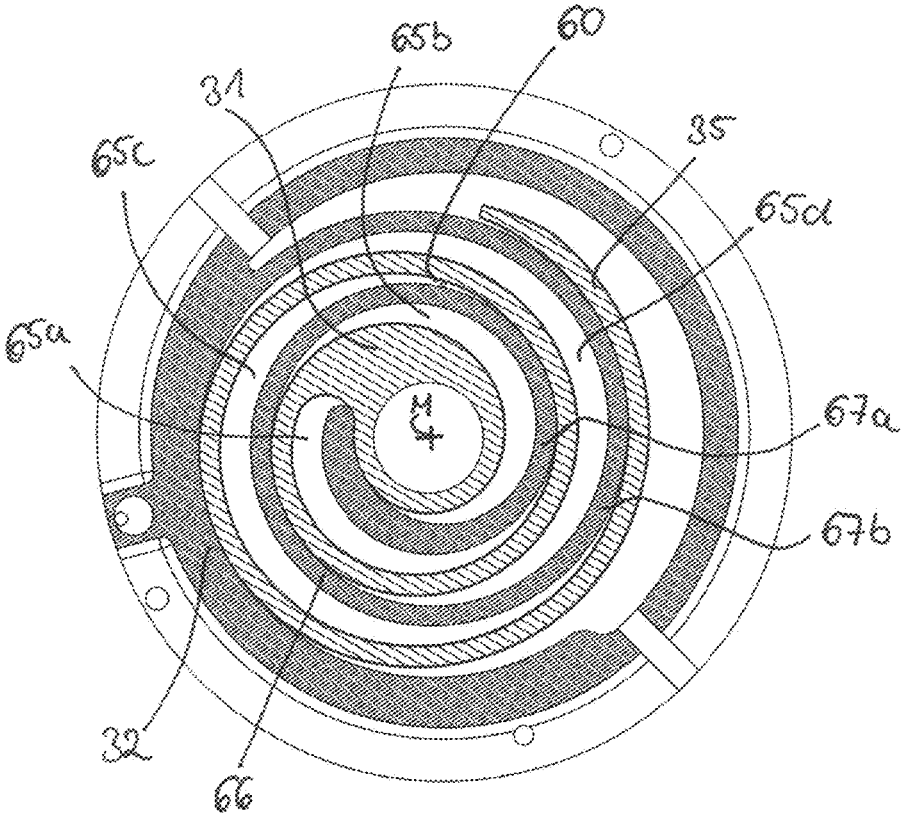

Various positions of the spirals 31 and 32 with respect to one another result, depending on the time of the compression process, so that, as is illustrated in FIGS. 3*a*-3*b*, one or none of the two passages 60 and 61 is free, and a fluid connection from the respective compression chamber to the counterpart-pressure chamber 50 can be produced.

A view onto the positive-displacement spiral 31 from above is illustrated in FIGS. 3*a* and 3*b*, wherein the spiral element 66 or the spiral flank sections 67*a*, 67*b* of the counterpart spiral 32 can be seen. By contrast, the base 33 of the counterpart spiral 32 cannot be seen.

In FIG. 3*a*, the two passages 60 and 61 are closed, i.e. the spiral element 66 of the counterpart spiral 32 or the spiral flank sections 67*a* and 67*b* cover the passages 60 and 61. In other words, in FIG. 3*a*, the 0° position of the compression process is illustrated. In this case, the coolant was already sucked in and the corresponding compression chambers 65*a*-65*e* were formed. The compression chamber 65*e* is the compression chamber, which is first closed in the flow direction.

By contrast, in FIG. 3*b*, an 80° position is illustrated. In this position, the first passage 60 is just opened. This corresponds to a 90% point of the relative volume, as is explained in detail in FIG. 5.

In FIG. 3*a*, no fluid connection from the compression chambers 65*a*-65*e* to the counterpart-pressure chamber 50 is possible. By contrast, in FIG. 3*b*, owing to the opening of the first passage 60, a fluid connection can be produced between the compression chamber 65*c* and the counterpart-pressure chamber 50.

Figure 4:
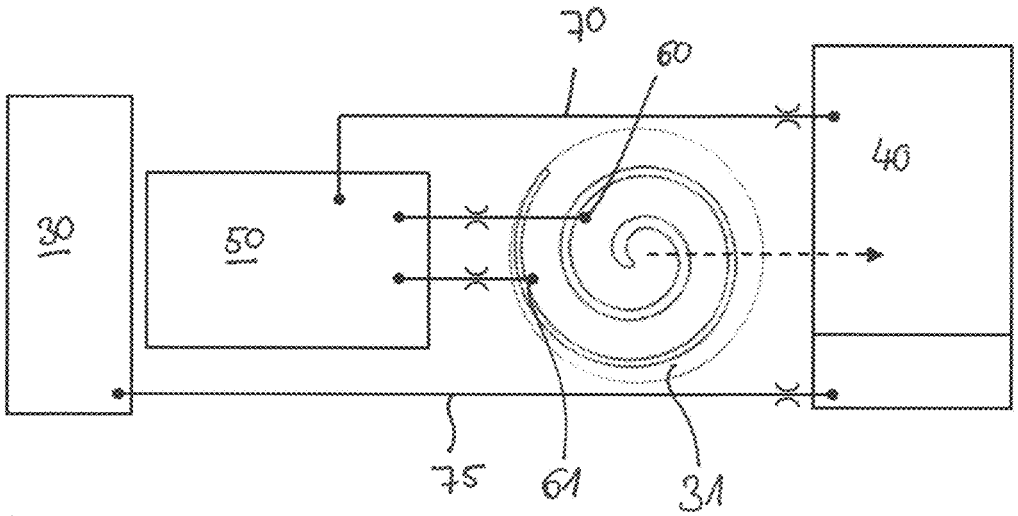
FIG. 4 shows a schematic illustration of the operating principle of the positive-displacement machine according to the invention.

In FIG. 4, the basic principle of the positive-displacement machine according to the invention is illustrated schematically. The low-pressure chamber or suction chamber 30, the high-pressure chamber 40 and the counterpart-pressure chamber and the back-pressure space 50 can be seen. An oil return channel 75 is constructed between the high-pressure chamber 40 and the low-pressure chamber 30. The oil return consequently takes place exclusively between the high-pressure chamber 40 and the low-pressure chamber 30. Separately, the gas connection line 70 is constructed between the high-pressure chamber 40 and the counterpart-pressure chamber 50. The first passage 60 and the second passage 61 in the positive-displacement spiral 31 can likewise be seen. Owing to the passages 60 and 61 constructed, connections from the compression chambers 65*a*-65*e* to the counterpart-pressure chamber 50 are possible.

Figure 5:
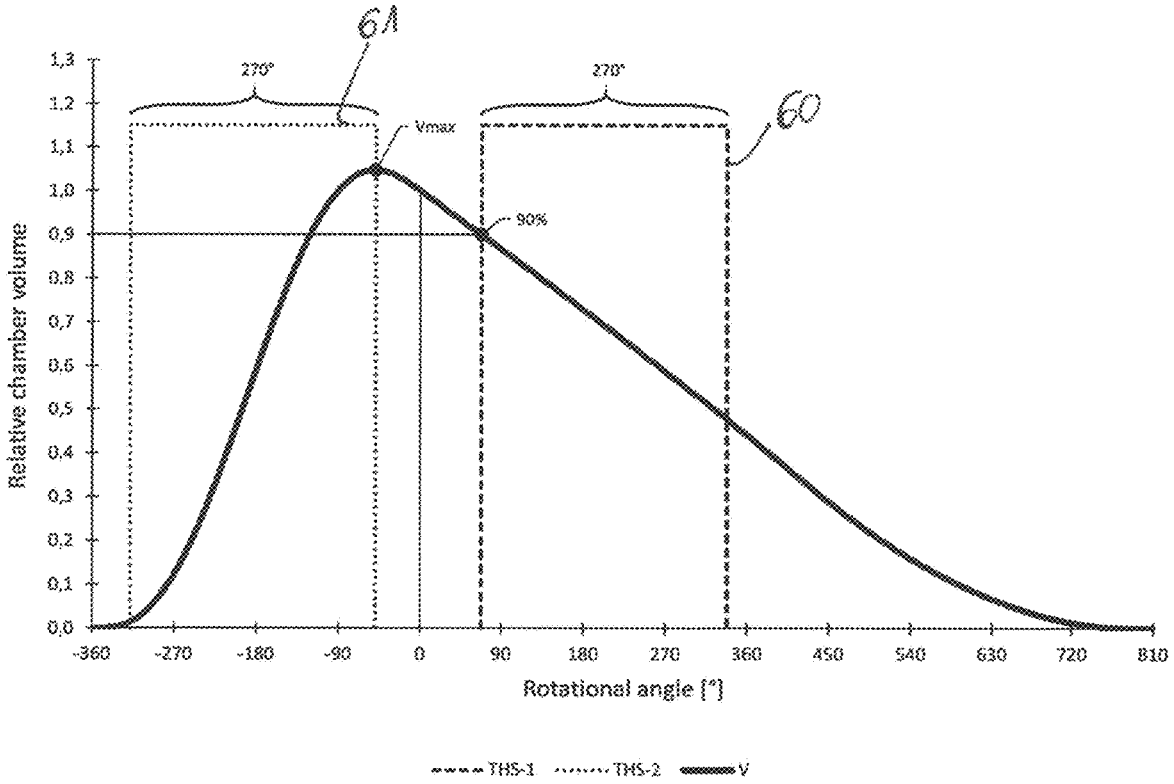
FIG. 5 shows an illustration of the opening time periods of the passages as a function of the angle of rotation.

A volumetric change curve of a scroll compressor is illustrated in FIG. 5. This volumetric change curve is in principle approximately identical for all scroll compressors and independent of the coolant used. The angle of rotation (rotational angle) 0° in this case shows the start of the compression process in a scroll compressor. The graphs THS-1 and THS-2 can likewise be seen. In this case, THS-1 illustrates the times in the compression process at which the first passage 60 is open as a function of the relative volume in the compression chamber. It can be seen that the first passage 60 is constructed in a section of this type, particularly in a central section 38 of the positive-displacement spiral 31 of this type, in which the first passage 60 is open in the activated state of the positive-displacement machine when 90% of the relative compression chamber volume is reached and subsequently remains open, after the opening, during a subsequent rotation of the positive-displacement spiral 31 by an angle of rotation of 270°. The first passage 60 is opened in the present case at an angle of rotation of 80°. By contrast, the closure of the first passage takes place at an angle of rotation of 350°.

Furthermore, the closing time of the second passage 61 (THS-2) is illustrated in FIG. 5. Consequently, the second passage 61, which is constructed in the initial region 37 of the positive-displacement spiral 31, is to be closed at the time at which the maximum relative compression chamber volume (Vmax) is present. The closure consequently takes place at an angle of rotation of −50°, wherein the negative angle of rotation is to be interpreted in relation to 0° angle of the scroll compressor 10, at which the compression process starts. Consequently, the second passage 61 is open prior to the closure for approx. 270°.

In other words, the second passage 61 is constructed in a section of the positive-displacement spiral 31 of this type, in which the second passage 61 is closed when the maximum relative compression chamber volume and is open during a rotation, prior to the closure, of the positive-displacement spiral 31 by an angle of rotation of 270°.

Figure 6:
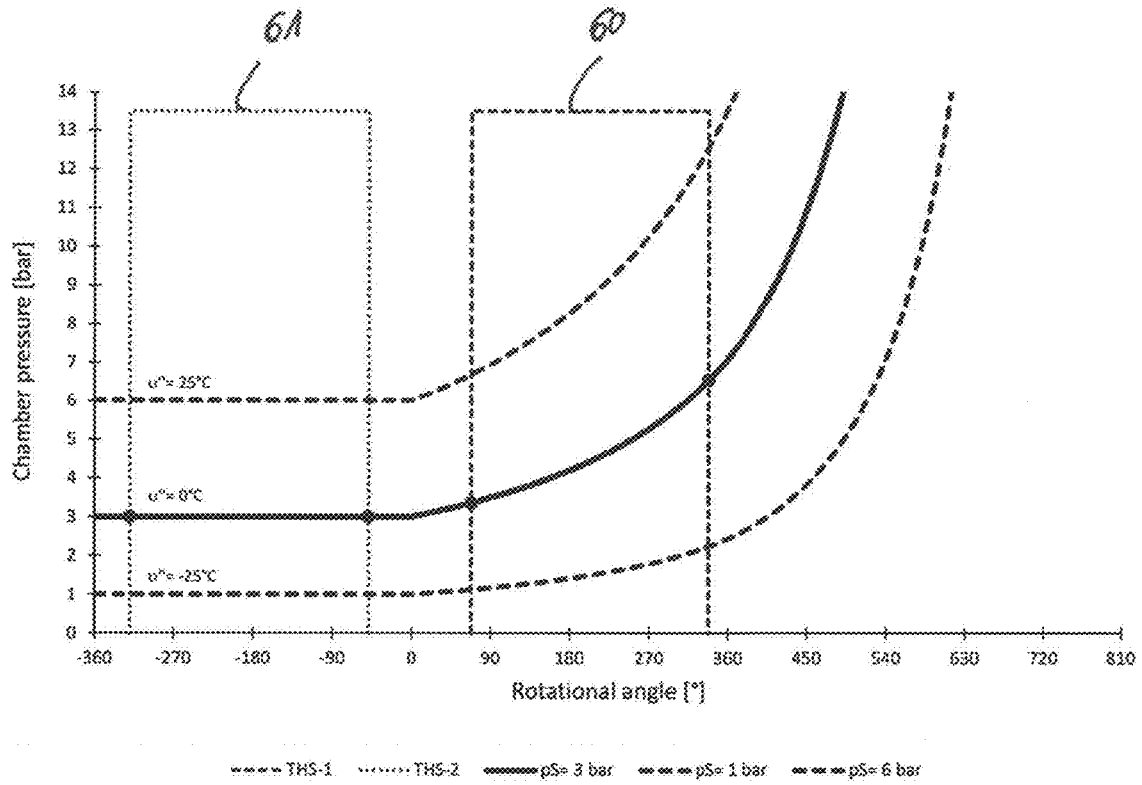
FIG. 6 shows an illustration of the pressure in the compression chamber as a function of the angle of rotation and of the chosen suction pressure in connection with the coolant R134a used.

The opening time periods of the passages 60 and 61 are likewise illustrated in FIG. 6. The illustration corresponds to a scroll compressor 10, wherein R134a is used as coolant. The graphs illustrated are coolant-dependent. The graphs are furthermore illustrated for different suction pressures (pS) of 3 bar, 1 bar and 6 bar. As can be seen, the behaviour of the pressure in the compression chamber (chamber pressure) is illustrated as a function of the angle of rotation (rotational angle). For a suction pressure or low pressure of 1 bar, the compression curve runs relatively flat, whereas the compression curve runs relatively steeply at a suction pressure of 6 bar. The suction pressures 3 bar, 1 bar and 6 bar represent the respective saturation temperatures/evaporation temperatures u" −25° C., 0° C. and 25° C. A standard scroll compressor must provide corresponding temperatures in vehicle air-conditioning systems in a temperature range of −25° C. to +25° C., so that the suction pressure (pS) varies in a range from 1 bar-6 bar.

Figure 7:
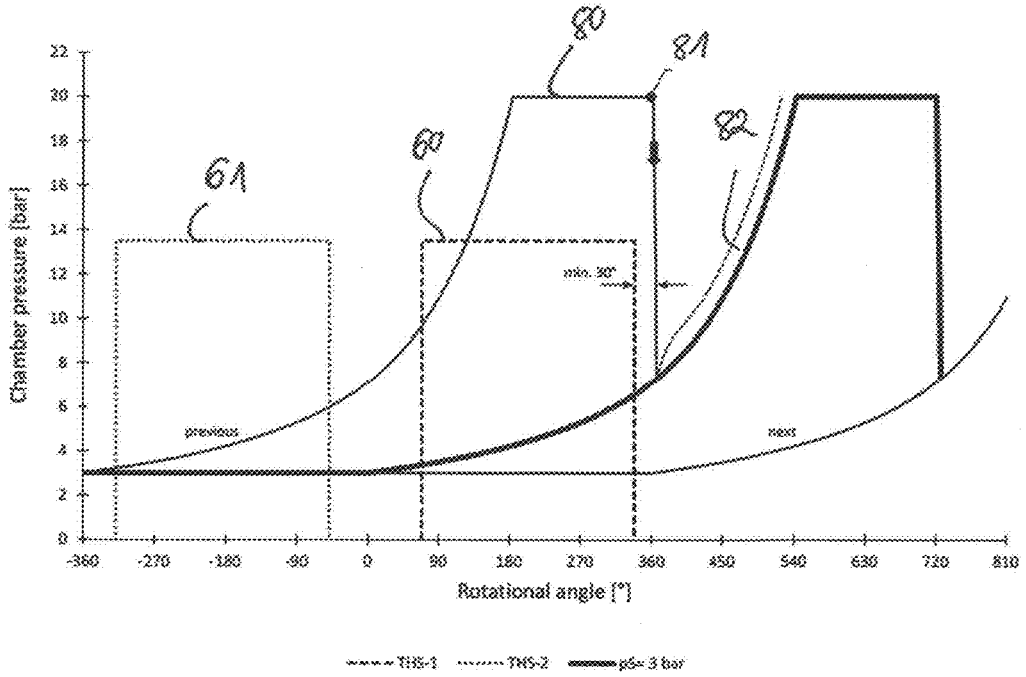

In FIG. 7, graphs are in turn depicted, which illustrate pressures in the compression chamber (chamber pressure) as a function of the angle of rotation (rotational angle). In this case, the current compression cycle is illustrated with a thick solid line. The previous cycle and the next cycle are indicated with thinner lines. With respect to the current compression cycle, the opening duration of the first passage 60 (THS-1) and the second passage 61 (THS-2) is additionally illustrated.

It can be seen that a compression pressure of 20 bar is achieved, wherein the flattened upper part of the graph describes the expulsion limit 80. At this limit 80, the compressed gas is expelled into the high-pressure chamber 40. The expulsion takes place at an angle of rotation of approx. 180° to 360°. The graph furthermore indicates the so-called discharge angle 81. This discharge angle 81 relates to the time at which the last compressed gas was expelled into the high-pressure chamber and subsequently the pressure in the compression chamber falls suddenly. The gas compressed in the compression chamber is not expelled completely. Residual gas remains in the compression chamber. This must not be expelled into the counterpart-pressure chamber 50 however, so that the first opening 60 must be closed before the discharge angle 81 is reached. According to FIG. 7, the first passage 60 is to be closed at least 30° before the discharge angle 81 is reached. The area 82, which is formed between the graph of the current compression cycle and a dashed line located thereabove, represents the residual gas of the previous compression cycle, which was not expelled into the high-pressure chamber.

Figure 8:
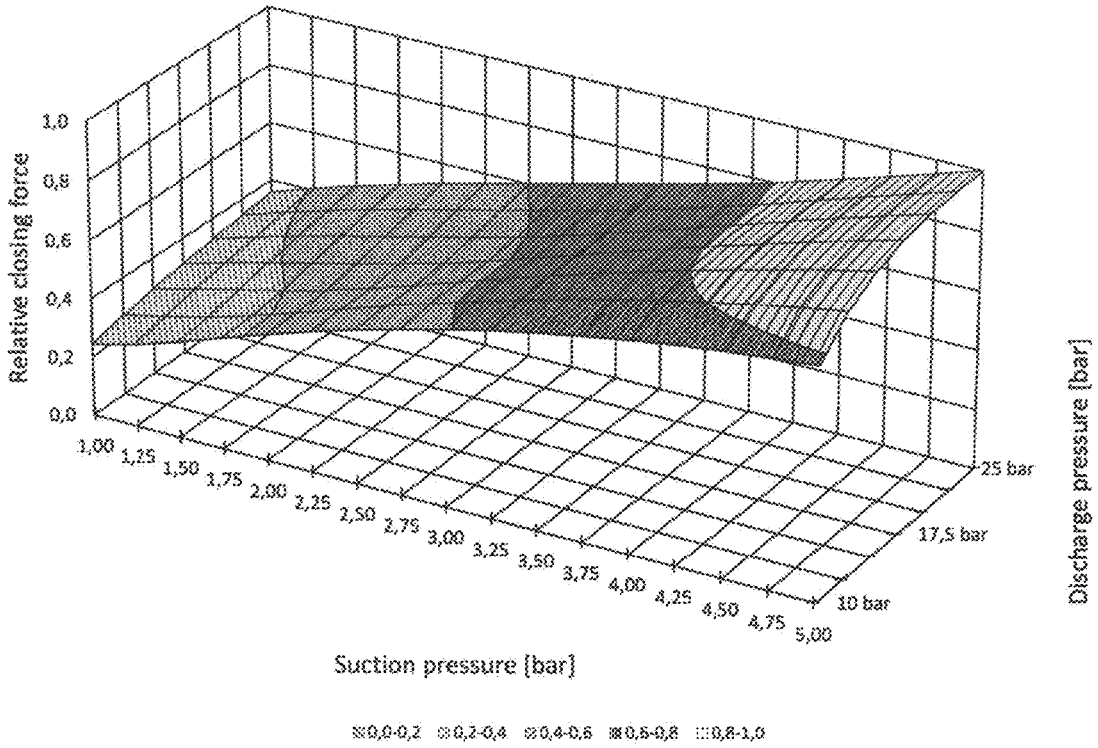
FIG. 8 shows an illustration of the closing force in relation to the suction pressure and the final pressure to be achieved.

In FIG. 8, an area is illustrated, which illustrates the relative closing force relating to the positive-displacement spiral 31 and the counterpart spiral 32. This is illustrated as a function of the suction pressure and the final pressure (discharge pressure) to be achieved. It becomes clear that with increasing final pressure, the closing force must also be increased. The illustration of FIG. 8 relates in turn to a scroll compressor, which is operated with the working medium R134a. Actually, for safety, higher closing forces are created than is illustrated in FIG. 8.

Figure 9:
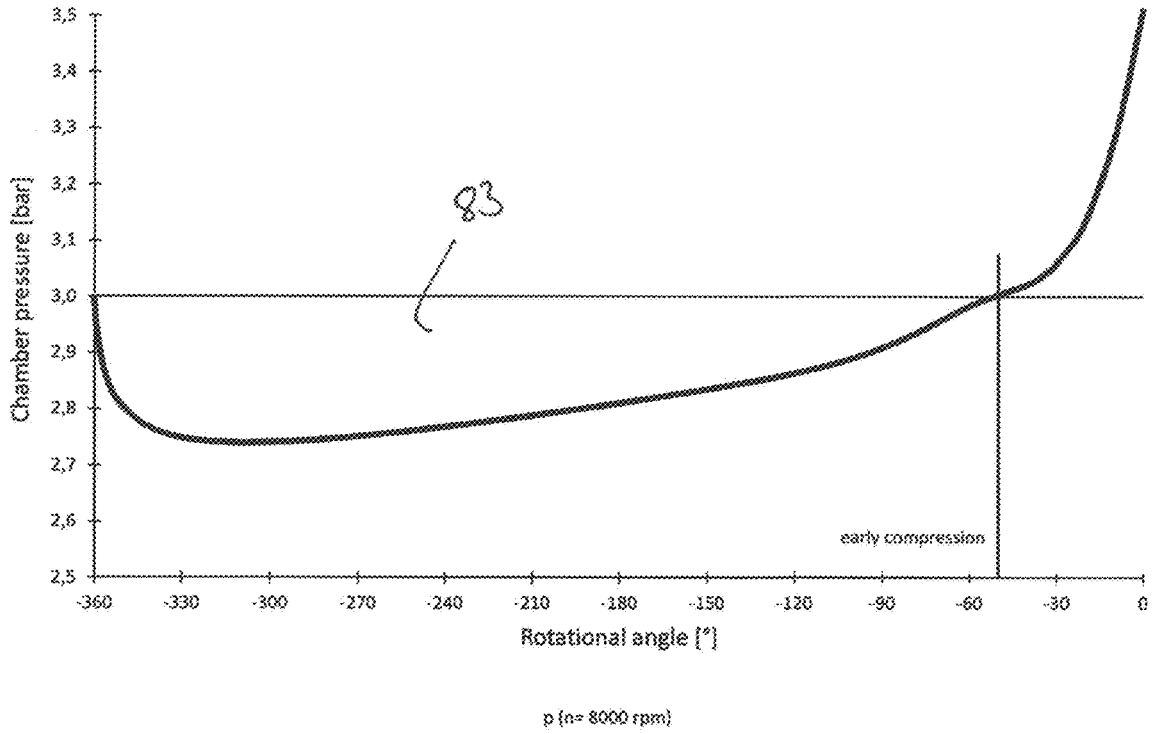
FIG. 9 shows an illustration of the pressure behaviour during the intake phase.

By contrast, the dynamic effects in the intake phase of a compression process are illustrated in FIG. 9. This illustration also relates in turn to a compression with the coolant R134a. An underpressure can accordingly arise in the intake phase or in the intake region of the positive-displacement spiral. In the case of an underpressure, no increased pressure must be present in the counterpart-pressure chamber, the underpressure already presses the two spirals 31 and 32 against one another. The area 83, which runs between the horizontal, which runs through the intersection point 3.0 bar, and the graph, which describes the pressure in the compression chamber in the intake phase, is detected by means of a corresponding opening of the second passage 62 during the angle of rotation (rotational angle) of −360°-50°.

Overall, it is true that a technical advantage results, owing to the positive-displacement machine according to the invention or owing to the scroll compressor according to the invention, that by means of the detection of a plurality of pressures in various phases of the compression and in various sections of the compression chambers, the pressure in the counterpart chamber can be set in a more optimal manner, particularly lower.

Figure 10:
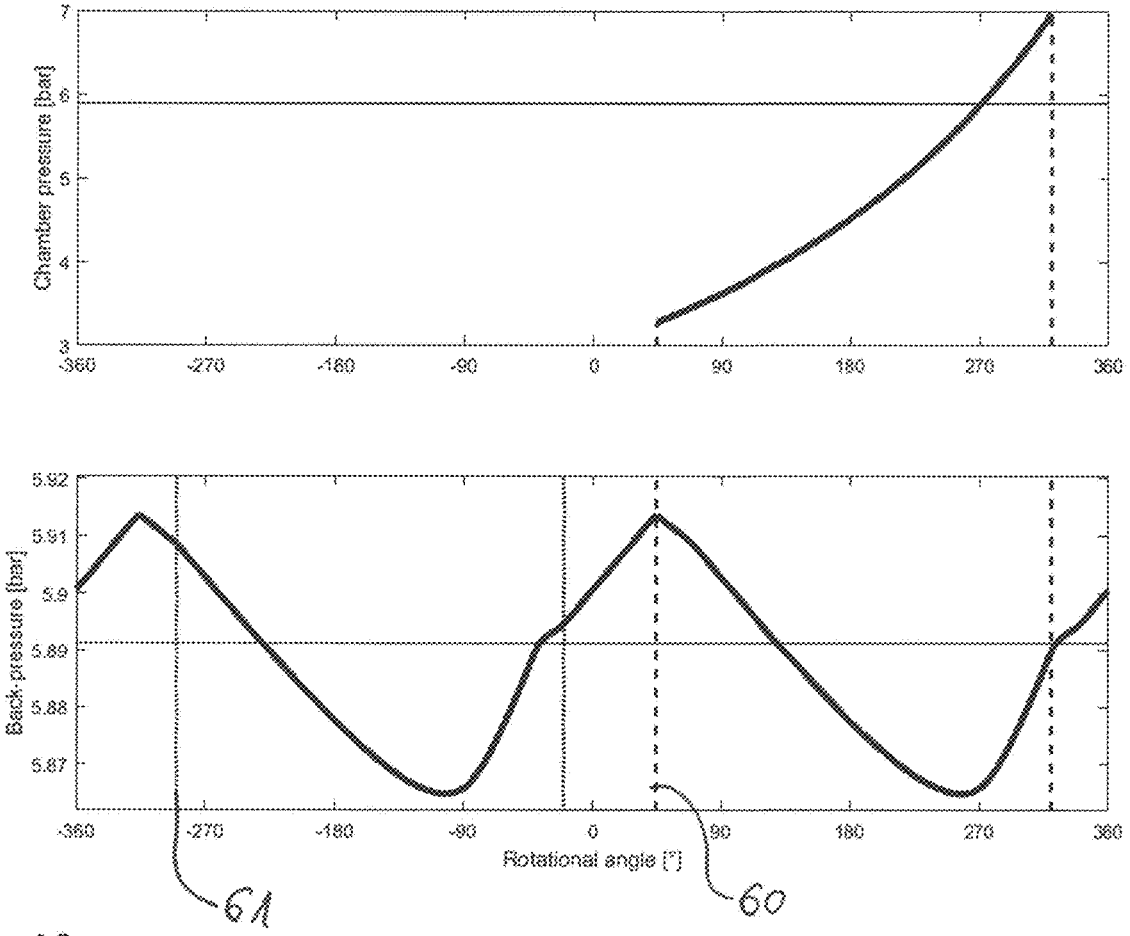

In FIG. 10, as a function of the angle of rotation (rotational angle), on the one hand, the curve of the counterpart-chamber pressure (back pressure) and on the other hand, the curve of the compression chamber pressure (chamber pressure) is illustrated. In the lower illustration, the opening sections of the first passage 60 and the second passage 61 are also illustrated. These graphs have also been created in connection with the coolant R134a. It is very clearly illustrated that with increasing pressure in the compression chamber (chamber pressure), the pressure in the counterpart-pressure chamber falls accordingly, so that it is accordingly necessary to implement countermeasures in this regard.

REFERENCE LIST

10 Scroll compressor
11 Mechanical drive
12 Drive shaft
13 Shaft end
14 Driver
15 Circumferential wall
20 Housing
21 Upper housing part
22 Housing partition wall
23 Housing base
24 First shaft seal
25 Second shaft seal
26 Eccentric bearing
27 Eccentric pin
28 Bearing bushing
29 Sliding ring
30 Low-pressure chamber
31 Positive-displacement spiral
32 Counterpart spiral
33 Base, counterpart spiral
34 Base, positive-displacement spiral
35 Spiral element
36*a*, 36*b*, 36*c* Spiral flank section
37 Initial region
37*a* Opening
38 Central section
39 Spiral duct
39*a* End section
40 High-pressure chamber
41 Side wall
42 Recess
43 Sealing ring
44 Outlet
45 Oil separator
46 Opening
47 High-pressure region
48 Outlet
50 Counterpart-pressure chamber
60 First passage

61 Second passage
65*a*, 65*b*, 65*c*, 65*d*, 65*e* Compression chamber
66 Spiral element
67*a*, 67*b* Spiral flank section
70 Gas-connection line
71 Throttle
75 Oil return channel
76 Throttle
80 Expulsion limit
81 Discharge angle
82 Area
83 Area
M Centre point, positive displacement spiral

What is claimed is:

1. A scroll compressor comprising:

a high-pressure chamber, a low-pressure chamber, an orbiting positive-displacement spiral, which engages into a counterpart spiral so that compression chambers are formed between the orbiting positive-displacement spiral and the counterpart spiral, in order to accommodate a working medium, and a counterpart-pressure chamber being constructed between the low-pressure chamber and the orbiting positive-displacement spiral, wherein the orbiting positive-displacement spiral has at least two passages, which at least temporarily produce a fluid connection between the counterpart-pressure chamber and at least one of the compression chambers, the at least two passages including a first passage and a second passage, wherein the first passage is essentially constructed in a central section of the orbiting positive-displacement spiral and at least one second passage is constructed in the initial region of the orbiting positive-displacement spiral, wherein the first passage is constructed in a section of the orbiting positive-displacement spiral, in which the first passage in the activated state of the scroll compressor is open when 85% of the relative compression chamber volume is reached, and remains open during a rotation of the orbiting positive-displacement spiral, subsequent to opening, by an angle of rotation of 180°, and wherein a gas-connection line is formed from the high-pressure chamber of the scroll compressor to the counterpart-pressure chamber.

2. The scroll compressor according to claim 1, wherein the first passage and/or the at least second passage is constructed in a section of the base of the orbiting positive-displacement spiral.

3. The scroll compressor according to claim 1, wherein the second passage is constructed in a section of the orbiting positive-displacement spiral, in which the second passage is closed when the maximum compression chamber volume Vmax is reached, and is open during a rotation, prior to the closure, of the orbiting positive-displacement spiral by an angle of rotation of 180°.

4. The scroll compressor according to claim 3, wherein the maximum compression chamber volume Vmax is assigned to an angle of rotation $\alpha$Vmax, wherein the second passage is closed when the angle of rotation $\alpha$Vmax+/−30° is reached.

5. The positive displacement machine scroll compressor according to claim 1, wherein the first passage is closed at least at an angle of rotation of 30°, before the discharge angle is reached.

6. The scroll compressor according to claim 1, wherein the gas-connection line is constructed in the housing and connects the high-pressure chamber to the counterpart-pressure chamber.

7. The scroll compressor according to claim 1, wherein an oil return channel is formed from the high-pressure chamber of the scroll compressor to the low-pressure chamber.

8. A method for operating a scroll compressor according to claim 1, comprising opening the first passage when 85% of the relative compression chamber volume is reached, and remains open during a rotation of the orbiting positive-displacement spiral, subsequent to opening, by an angle of rotation of 180°.

9. The method according to claim 8, comprising closing the second passage when the maximum relative compression chamber volume Vmax is reached, and is open during a rotation, prior to the closure, of the orbiting positive-displacement spiral by an angle of rotation of 180°.

10. A vehicle air-conditioning system having a scroll compressor according to claim 1.

11. A vehicle having a scroll compressor according to claim 1.

* * * * *